United States Patent [19]

O'Brien

[11] Patent Number: 4,722,625

[45] Date of Patent: Feb. 2, 1988

[54] REMOTE CONTROL DEVICE FOR POWERED PAINTING SYSTEM

[75] Inventor: Lawrence B. O'Brien, Carmel, Ind.

[73] Assignee: Triune Automated Painting Systems, Carmel, Ind.

[21] Appl. No.: 780,423

[22] Filed: Sep. 26, 1985

[51] Int. Cl.[4] ..... B05C 1/10; H01H 9/06; H01H 13/08

[52] U.S. Cl. ..... 401/6; 200/157; 200/DIG. 2; 340/696; 401/146; 401/188 R; 401/195

[58] Field of Search ..... 401/146, 188 R, 6, 195, 401/188; 200/157, DIG. 2; 340/696; 239/153

[56] References Cited

U.S. PATENT DOCUMENTS

| | | | |
|---|---|---|---|
| 1,173,269 | 2/1916 | Heidemann | 200/DIG. 2 X |
| 1,197,652 | 9/1916 | Newton | 200/157 X |
| 1,832,303 | 11/1931 | Howe | 401/146 |
| 3,020,579 | 2/1962 | O'Connor | 401/188 |
| 3,315,263 | 4/1967 | Lefevre | 340/696 X |
| 3,457,017 | 7/1969 | Bastian | 401/146 |
| 3,700,836 | 10/1972 | Rackson | 200/DIG. 2 X |
| 3,906,369 | 9/1975 | Pitman et al. | 340/696 |
| 3,960,229 | 6/1976 | Shio | 180/9.1 X |
| 4,059,830 | 11/1977 | Threadgill | 200/DIG. 2 X |
| 4,231,668 | 11/1980 | Groth et al. | 401/146 |
| 4,300,129 | 11/1981 | Cataldo | 200/DIG. 2 X |
| 4,422,789 | 12/1983 | Charney et al. | 401/146 X |
| 4,424,011 | 1/1984 | O'Brien et al. | 401/197 X |
| 4,510,625 | 4/1985 | Mizuki | 200/DIG. 2 X |
| 4,546,922 | 10/1985 | Thometz | 239/153 X |
| 4,573,046 | 2/1986 | Pinnow | 340/696 X |

FOREIGN PATENT DOCUMENTS

| | | | |
|---|---|---|---|
| 405998 | 7/1966 | Switzerland | 401/188 |

*Primary Examiner*—Steven A. Bratlie
*Attorney, Agent, or Firm*—Woodard, Emhardt, Naughton, Moriarty & McNett

[57] ABSTRACT

A powered painting system includes a motor driven paint pump controlled by a radio signal receiver associated with it. A radio frequency transmitter mounts to the wrist of the painter, and a small clip with a button-operated switch thereon is provided for mounting to the finger of the painter, with the button readily accessible to the thumb of the painter. Upon operation of the button by the thumb, the transmitter sends a signal to the receiver which turns the pump on. Upon subsequent operation of the button, the transmitter sends a further signal which, upon receipt by the receiver, turns off the pump.

6 Claims, 9 Drawing Figures

REMOTE CONTROL DEVICE FOR POWERED PAINTING SYSTEM

BACKGROUND OF THE INVENTION

This invention relates generally to powered painting systems, and more particularly to wireless remote control for a paint pump.

Painting systems having the paint supplied to the applicator under pressure, are known. There are a number of patents which disclose the use of a pump to pump paint from a reservoir to an applicator. Among these are patents which show a valve at the handle of a paint roller to control the paint supplied to the roller. An example is U.S. Pat. No. 4,231,668 issued to Groth et al. on Nov. 4, 1980. It shows a paint control valve on the roller handle to pinch the hose 19. A pump stop switch 22 is provided adjacent the pump. A different type of control is disclosed in U.S. Pat. No. 3,457,017 issued July 22, 1969 to J. W. Bastian. That patent discloses the idea of an electrically-powered paint pump controlled by a manually operable switch 24 on the roller handle and wired to the pump to turn it on and off. U.S. Pat. No. 4,422,789 issued Dec. 27, 1983 to Charney et al. discloses a motor-driven paint pump supplying paint to a roller assembly. A switch 84 is mounted to the roller handle and wired to a pump and operable to turn the pump on and off. Shio U.S. Pat. No. 3,960,229 issued June 1, 1976 shows remote control of a ship hull painting carriage. Remote control by radio control is mentioned as a possibility in one sentence at the end of column 5. There is a U.S. Pat. No. 4,424,011, issued Jan. 4, 1984, based on an original application by me and my co-inventors and which disclosed radio operated remote control of a pump in a power painting system, with the radio transmitter and control for it being mounted on the roller handle. Although that control was significant in terms of added convenience of painting, the present invention is a further and significant step toward added convenience.

SUMMARY OF THE INVENTION

Described briefly, according to a typical embodiment of the present invention, a powered painting system includes a motor-driven paint pump and a wireless signal receiver controlling the pump. A wireless signal transmitter is packaged for mounting to the wrist of the painter. A finger ring with a button-operated switch thereon is provided for mounting to the finger of the painter, with the button readily accessible to the thumb of the painter. Upon operation of the button by the thumb, the transmitter sends a signal to the receiver which turns the pump on. Upon subsequent operation of the button, the transmitter sends a further signal which, upon receipt by the receiver, turns off the pump. Pump control is thereby established and maintained, without adding bulk or weight to the painting roller, pad or brush handle itself. In addition to the added convenience, any prior concern about possible contamination of the transmitter while cleaning the painting equipment, particularly the handle and roller and associated tubing, is completely eliminated.

DESCRIPTION OF THE PREFERRED EMBODIMENT

Figure 1:
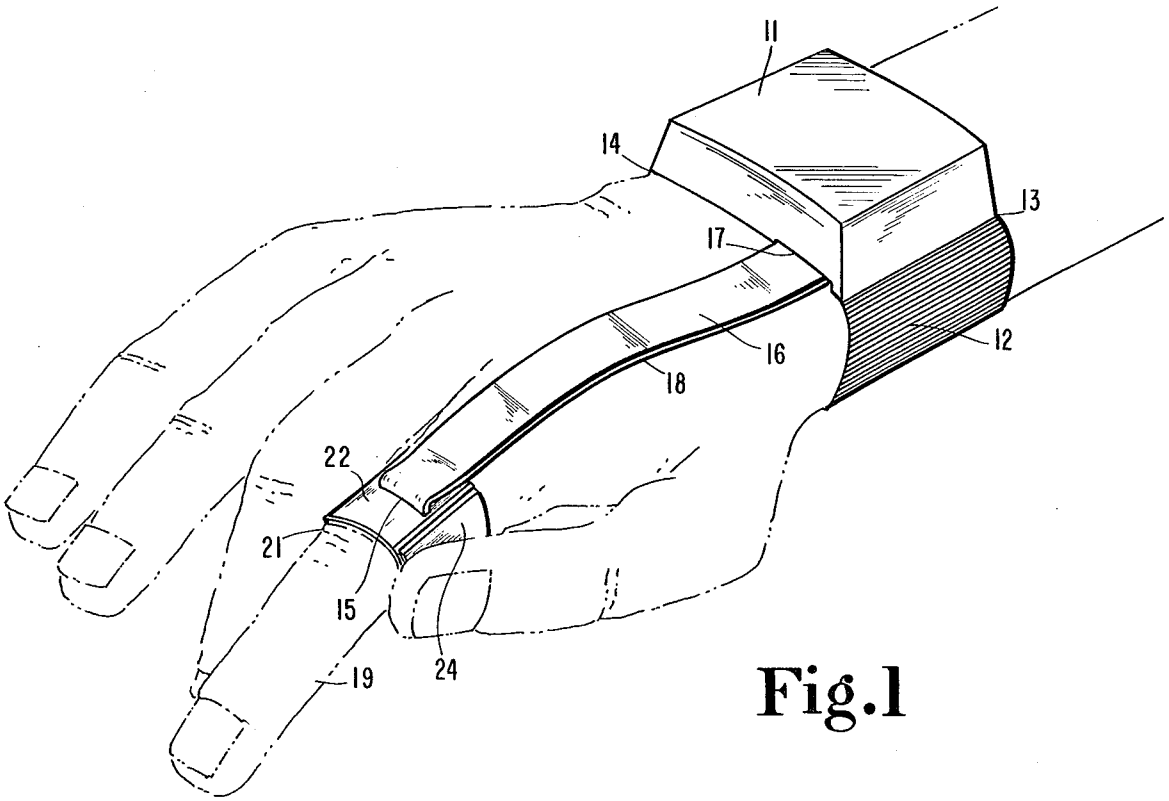
FIG. 1 is a pictorial view of the painting system transmitter and finger tip control switch assembly according to one embodiment of the present invention.
Figure 6:
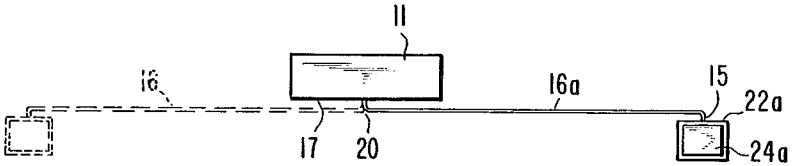
FIG. 6 is a side elevational view of the left-hand configuration and omitting the wrist mounting band.

Referring now to the drawings in detail, FIG. 1 shows the right-hand of the painter, with a wrist transmitter assembly 11 secured to the wrist by an elastic band 12, passing under the wrist from one margin 13 of the transmitter to the other margin 14. A strap 16 is received in a channel 17 in the bottom of the transmitter housing and extends over the knuckle 18 along the top of the index finger 19. The strap is attached to the housing at line 20 (FIG. 6) centrally located between the front and rear edges of the housing. A generally U-shaped discontinuous ring 22 is received on the finger 19 just above the knuckle 21. It has a switch pad 24 on the side. Strap 16 is attached to the ring at line 15, halfway between the front and rear edges. The strap may be sufficiently flexible that the attachments of the strap to the ring at 15 and housing at 20, function effectively as hinges to enable the alternative positioning shown in FIG. 6, to be described hereinafter. Alternatively, a discrete hinge pin or the like could be provided at either or both locations 15 and 20, if desired. The ring 22 may be made of a resilient material so that it can clip over the index finger, but not be unduly tight. Metal or plastic materials can be used, but others may work as well. With the strap being of leather or some reasonably sturdy but flexible material, it will permit the use of a ring which does not clip onto but fits loosely on the finger, and the strap orientation will keep the ring from rotating on the finger. Accordingly, the switch pad or button is kept in position for operation by the thumb, as shown in FIG. 1.

Figure 2:
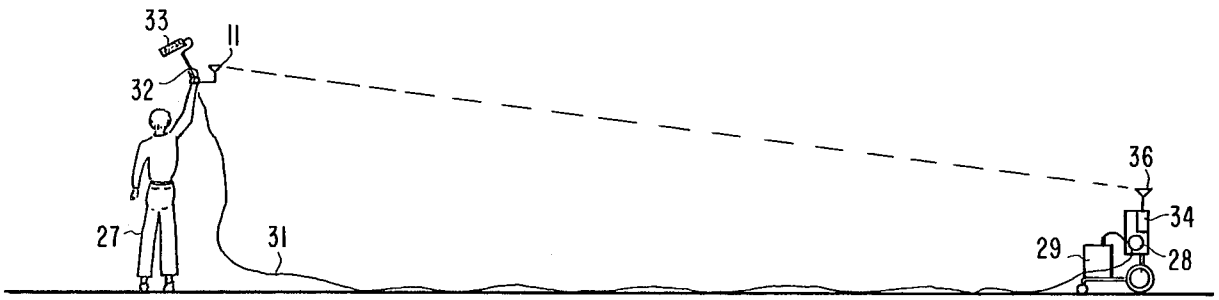
FIG. 2 is an illustration of the painting system.
Figure 4:
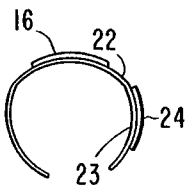
FIG. 4 is a front elevational view of the finger switch assembly.

As shown in FIG. 2, the painter 27 is roller painting a wall at a location remote from the paint pump 28. Paint is supplied by the pump from the reservoir 29 through a hose 31 and the handle 32 of the roller to the roller cover 33. Such a system is generally shown in the above-mentioned U.S. Pat. No. 4,424,011, as a safety measure. The original application Ser. No. 218,354, filed Dec. 22, 1980, and from which that patent issued, both of which are incorporated herein by reference, included a disclosure of a remote control transmitter in the paint roller handle, and a receiver generally adjacent the paint pump such as at 34 in FIG. 2 herein, and which controlled the paint pump motor 172. Therefore, FIG. 2 herein shows the radio antenna symbol 11 associated with the wrist transmitter, and the radio antenna symbol 36 at the receiver 34, whereby the receiver can turn the pump on and off in response to signals received from the transmitter 11 herein mounted to the wrist of the painter. The receiver is tuned to the same frequency as the transmitter.

By pressing the switch button 24, a signal of the tuned frequency is sent from the transmitter to the receiver to cause the pump to turn on or turn off. The first signal will turn it on. The second signal will turn it off. The next signal will turn it on. The next will turn it off. If desired, coded signals or signal sets can be used, as is done in the art of garage door controllers, for immunity to transient signals.

Figure 5:
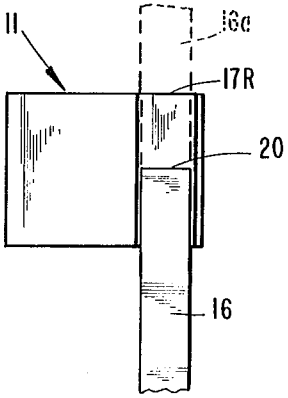
FIG. 5 is a bottom plan view of the transmitter unit, showing in dashed lines the original location, and in solid lines the alternative location of the finger switch strap for a left-handed painter, but omitting the wrist mounting band.
Figure 3:
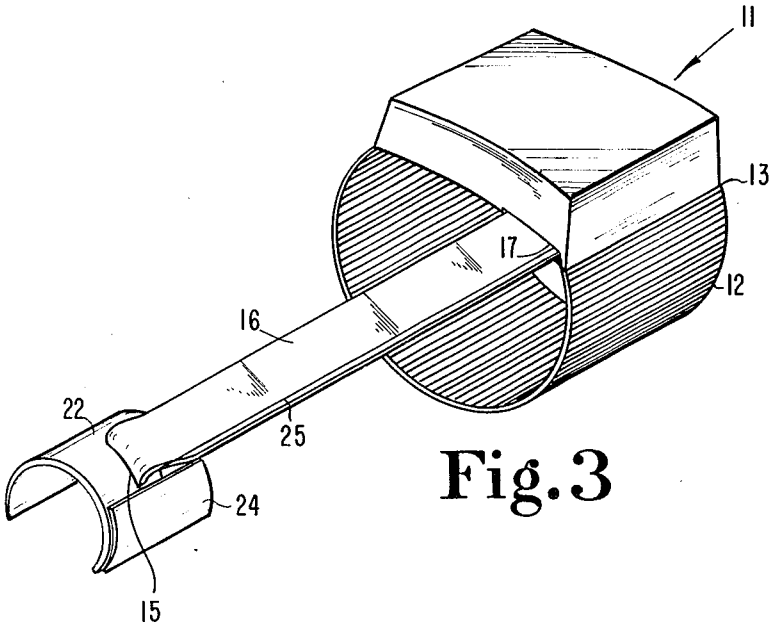
FIG. 3 is a pictorial view of the transmitter and switch assembly separate from the hand of the painter.

Button 24 is most convenient for operation by the thumb of a right-handed painter. If the control is to be used by a left-handed painter, the finger switch end of strap 16 can be swung downward and pulled through the wrist opening between the transmitter and band 12, and thereby reversed to the position shown in FIGS. 5 and 6, where the position of the parts for the left-handed painter are given the post-script "a". The hinge-like connections of the strap to the ring at 15 and to the transmitter at 20 make this possible. So the strap will be comfortably over the index finger of a left-handed painter. In this instance, the button 24 will be conveniently accessible to the left thumb of the painter for operation of the pump.

Although the finger switch is shown as a button or pad 24, which is helpful for tactile purposes, to feel when the switch has been operated, it is possible to have simply a pressure-operated switch with virtually zero travel. The strap 16 can be made of an electrically-conductive fabric material such as in the illustrated embodiment, with only a single insulated conductor 25 used for one path from the switch to the transmitter, with the strap itself serving as the return path from the switch to the transmitter. Alternatively, the strap can be of a molded ribbon-cable type of construction, with two wires embedded in it. Other wired strap constructions may be used. A suitable finger switch is an MCS type switch by the Schurter Corporation of Petaluma, Calif. Suitable transmitters and receivers can be of the conventional garage door controller type such as manufactured by Pulsar Control Corp. of Hendersonville, Tenn., for example. Single channel transmitter PDX931 and receiver PDD931 are examples. They operate at a frequency of 318 Mhz. Signals are encoded for security. An integrated circuit by Motorola, designated M145026P, is used for encoding in the transmitter, and one designated M145028P is used for decoding in the receiver. Although the preferred mode uses radio-frequency wireless control means, other types of wireless control means might also be used within the scope of this invention.

Figure 8:
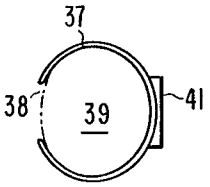
FIG. 8 is a front view of the finger ring and switch assembly of the second embodiment, the finger being designated by dashed lines.
Figure 9:
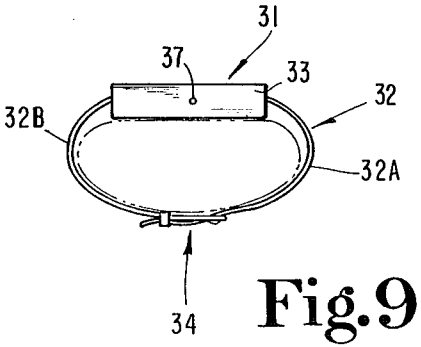
FIG. 9 is a front view of the transmitter and wrist band assembly of the second embodiment, the wrist being designated by dashed lines.
Figure 7:
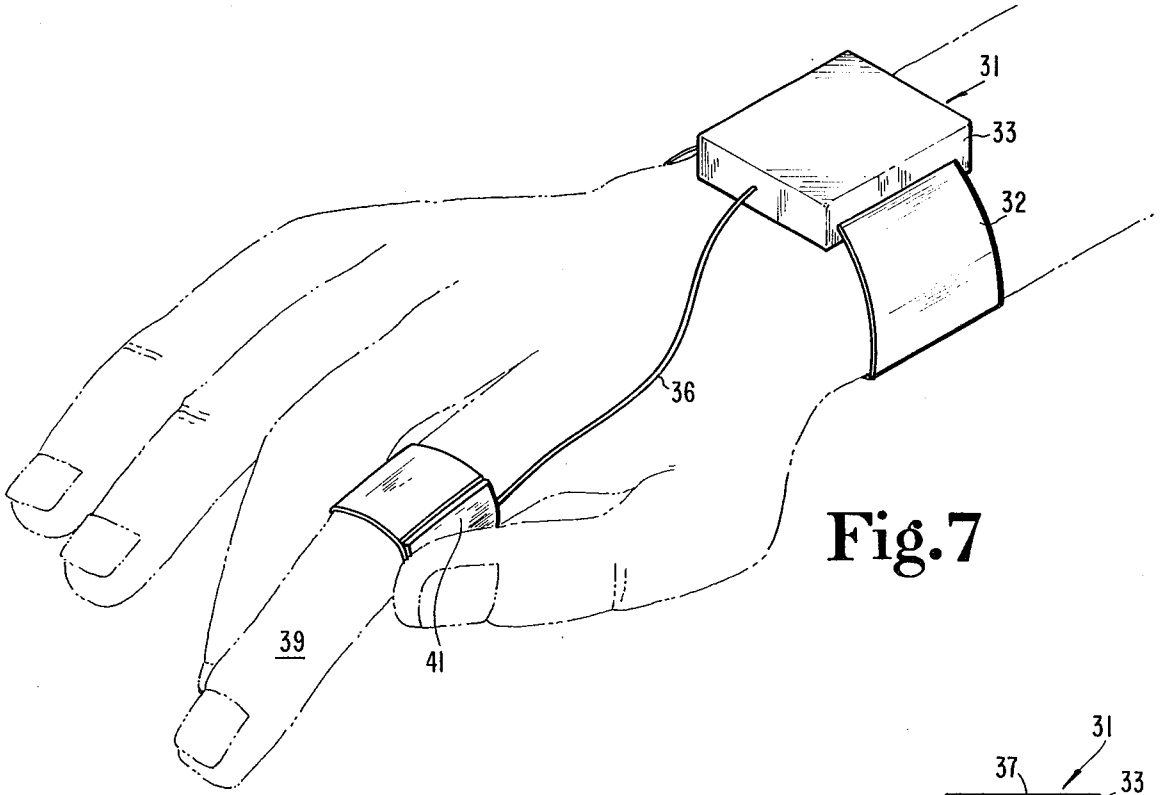
FIG. 7 is a pictorial view of a second embodiment of the invention.

In the second embodiment of the invention, which is illustrated in FIGS. 7, 8 and 9, the transmitter assembly 31 is constructed to be reversible. In doing this, the band 32 is mounted to the transmitter housing at 33, about half way between the top and bottom of the housing as is best shown in FIG. 9. Instead of there being an elastic band as in the previous embodiment, this band 32 is leather and includes the portions 32A and 32B with a reversible buckle 34 mounted to band portion 32B.

A flexible two-wire cable 36 is connected to the transmitter assembly housing at 37, centrally located between the side and between the top and bottom of the housing. The finger ring 37, instead of being open at the bottom, is open at the side as at 38 which, on the hand, is on the inside between the index finger 39 and the middle finger. The switch button is at 41 and the the cable 36 is connected to it. To keep the button in position at the side of the finger, it is desirable that the ring be slightly snug on the finger, in the manner of a clip, so that it does not turn on the finger.

By using the single cable 36 of a flexible nature with the two conductors in it, and using the finger clip mounted from the side of the finger, and reversible transmitter and band, it can be used without the pivoting strap feature of the first-described embodiment, by a left-handed painter. It is necessary to unbuckle the band, invert the transmitter assembly, wrap the band around the left wrist, and clip the finger clip from the thumb side onto the index finger of the left hand. The thumb switch 41 will be correctly located for operation by the left thumb. So it is seen that in either the first or second embodiment, the assembly can be reversed from a configuration for a right-handed painter, to a mirror image configuration for a left-handed painter.

Perhaps it should be mentioned that a non-elastic band can be used with the first-described embodiment. Leather would be a suitable material for that purpose. Similarly, with the second embodiment, a continuous, non-buckle type of elastic band could be used, if desired, in place of the illustrated leather band. Also, a linked metal type of band such as a "Speidel Twistoflex" brand band might also be used if desired. Such bands for wrist watches are known to be reversible, even if not intended to be used in the reversed configuration.

For the embodiment of FIGS. 7 through 9, the components can be the same as mentioned above, and the operation can be the same as described above for the embodiment of FIGS. 1 and 3 through 6 in the system of FIG. 2.

It should be apparent that the present invention provides for convenient control of a paint pump from a location remote from the pump, and it materially simplifies the paint applicator handle. While shown and described as turning a pump on and off, the present invention is contemplated as applicable to control of material flow or pressure in other ways such as by valve control, or other pump mode control such as pump speed or direction control, or a combination thereof. If multiple functions or modes are to be controlled, additional switch buttons may be used, or specific operating sequences developed for particular control functions to be performed. The wearing of the switch on a ring or clip is shown and described as the preferred embodiment. The switch might also be attached to the person by other means such as adhesive tape or in a glove or otherwise. Also, it is conceivable that equipment miniaturization will eventually enable inclusion of the transmitter with the switch on the finger. While the preferred application of the invention is in painting, it may be found applicable to other work. Application to cleaning equipment is an example.

It should be noted that, in the claims hereinafter, the term "digit" means one of the five fingers of a hand.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A controller for a remote control painting system comprising:

wireless signal transmitter means adapted to be worn on the person of a painter;

digit operable switch means adapted to be worn on a hand of the painter and operable by a digit on said hand, said switch means being associated with said transmitter means for control of said transmitter means;

means for controlling paint flow in response to a signal from said transmitter means; and wrist mounting means on said transmitter means for attaching said transmitter means to the wrist of a painter;

said wrist mounting means including an elastic band receivable around the wrist to secure the transmitter means to the wrist of the painter.

2. A controller for a remote control painting system comprising:

wireless signal transmitter means adapted to be worn on the person of a painter;

digit operable switch means adapted to be worn on a hand of the painter and operable by a digit on said hand, said switch means being associated with said transmitter means for control of said transmitter means;

means for controlling paint flow in response to a signal from said transmitter means; and wrist mounting means on said transmitter means;

said transmitter means and the wrist mounting means thereon being adapted for reversible mounting to the wrist of an arm.

3. A controller for a remote control painting system comprising:

wireless signal transmitter means adapted to be worn on the person of a painter;

digit operable switch means adapted to be worn on a hand of the painter and operable by a digit on said hand, said switch means being associaated with said transmitter means for control of said transmitter means;

finger receiving means;

said digit operable switch means being mounted to said finger receiving means; the apparatus further comprising:

electrical conductor means from the switch means to the transmitter means for enabling the switch means to electrically control the transmitter means;

means for controlling paint flow in response to a signal from said transmitter means; and band means attached to said transmitter means and oriented to encircle the painter's wrist to hold the transmitter means on one wrist of a painter;

said conductor means and finger receiving means being arranged to be reversible from one orientation for use by a right-handed painter to another orientation for use by a left-handed painter.

4. The apparatus of claim 3 and further comprising:

strap means having one end attached to said transmitter means and the other end attached to said finger receiving means, said finger receiving means including a ring slip-fittable on a finger and so oriented with respect to said strap means that said strap means prevents rotation of the ring on a finger, said ring having a switch operator adjacent said other strap end.

5. The apparatus of claim 4 wherein:

said strap means is hingedly attached to said ring and said transmitter to facilitate reversal from the one to the other orientation.

6. The apparatus of claim 3 wherein:

said transmitter means include a housing, said band means being mounted to said housing such that the band means and transmitter housing combination can be turned inside out and mounted to the opposite wrist of the painter.

* * * * *